US010605536B2

(12) United States Patent
Dietrich et al.

(10) Patent No.: US 10,605,536 B2
(45) Date of Patent: Mar. 31, 2020

(54) PLATE HEAT EXCHANGER WITH SEVERAL MODULES CONNECTED BY SECTIONS

(71) Applicant: LINDE AKTIENGESELLSCHAFT, Munich (DE)

(72) Inventors: Jörg Dietrich, Erding (DE); Reinhold Hölzl, Geretsried (DE)

(73) Assignee: LINDE AKTIENGESELLSCHAFT, Munich (DE)

( * ) Notice: Subject to any disclaimer, the term of this patent is extended or adjusted under 35 U.S.C. 154(b) by 966 days.

(21) Appl. No.: 13/852,461

(22) Filed: Mar. 28, 2013

(65) Prior Publication Data

US 2013/0277027 A1 Oct. 24, 2013

(30) Foreign Application Priority Data

Mar. 29, 2012 (DE) ..... 10 2012 006 477

(51) Int. Cl.

| | |
|---|---|
| ***F28F 9/007*** | (2006.01) |
| ***F28F 9/26*** | (2006.01) |
| ***F28D 9/00*** | (2006.01) |
| ***F25J 5/00*** | (2006.01) |
| ***F28F 9/00*** | (2006.01) |
| *F28F 3/08* | (2006.01) |

(52) U.S. Cl.

CPC ..... *F28D 9/0056* (2013.01); *F25J 5/002* (2013.01); *F28D 9/0068* (2013.01); *F28F 9/001* (2013.01); *F28F 9/0075* (2013.01); *F25J 2290/32* (2013.01); *F25J 2290/42* (2013.01); *F25J 2290/50* (2013.01); *F28F 3/083* (2013.01); *F28F 9/26* (2013.01)

(58) Field of Classification Search

CPC ..... F28F 3/083; F28F 9/002; F28F 9/0075; F28F 9/26; F25J 2290/42

USPC ..... 165/67, 78, 144

See application file for complete search history.

(56) References Cited

U.S. PATENT DOCUMENTS 2,184,657 A * 12/1939 Young ..... F28F 9/001 165/144
2,782,009 A * 2/1957 Rippingille ..... F28D 9/0062 165/153
3,346,041 A * 10/1967 Daltry ..... F28F 9/002 165/47

(Continued)

FOREIGN PATENT DOCUMENTS

DE 102009033661 A1 1/2011
EP 1087194 A1 3/2001

(Continued)

OTHER PUBLICATIONS

Search Report for EP 12004195 dated (Nov. 28, 2012).

(Continued)

*Primary Examiner* — Leonard R Leo

(74) *Attorney, Agent, or Firm* — Millen White Zelano & Branigan, PC

(57) ABSTRACT

The invention relates to a plate heat exchanger 1 with at least two cuboidal modules 1*a*, 1*b*. The two modules 1*a* and 1*b* are cuboidal and are each closed to the outside by cover sheets 5. The two modules 1*a* and 1*b* are arranged such that in each case, cover sheets 9*a* and 9*b* of the same size are directly adjacent. On the contact surfaces, sections 20*a*, 20*b* are welded that prevent movement of the two modules 1*a*, 1*b* perpendicular to the contact surfaces 9*a*, 9*b* either alone or with an additional formed part 50.

18 Claims, 7 Drawing Sheets

(56) References Cited

U.S. PATENT DOCUMENTS 3,372,453 A * 3/1968 Butt ..... B21D 53/04 165/166
3,633,661 A * 1/1972 Duncan ..... F28F 3/005 165/166
3,986,549 A * 10/1976 Huggins ..... F28F 3/00 165/166
4,297,775 A * 11/1981 Butt ..... B21D 53/04 165/166
4,729,428 A * 3/1988 Yasutake ..... F28D 9/0062 165/153
5,046,554 A * 9/1991 Iwasaki ..... F28D 1/0435 165/140
5,144,809 A 9/1992 Chevalier et al.
5,197,538 A * 3/1993 Nagasaka ..... F28D 1/0443 165/144
5,219,016 A * 6/1993 Bolton ..... F28F 9/002 165/67
6,237,676 B1 * 5/2001 Hasegawa ..... F28F 9/002 165/67
6,374,636 B1 4/2002 Thonnelier et al.
6,527,046 B1 * 3/2003 White ..... F28D 1/0443 165/144
7,147,046 B2 * 12/2006 Sanada ..... F28F 9/002 165/67
8,056,614 B2 * 11/2011 Chen ..... H01L 23/367 165/78
9,022,100 B2 * 5/2015 Ciaffarafa ..... F28F 9/0219 165/153
2005/0217832 A1 10/2005 Sanada et al.

FOREIGN PATENT DOCUMENTS

EP 1329680 A1 7/2003
EP 1990596 A1 11/2008
FR 2665755 A1 2/1992
WO 9518947 A1 7/1995
WO 2011006613 A2 1/2011

OTHER PUBLICATIONS

Opposition Brief filed in EP2645038 dated Jun. 2, 2016.
English machine translation of WO2011006613A2 published Jan. 20, 2011 to Bayer Technology Services GMBH.
English translation of EP1990596 published Nov. 12, 2008 to BEHR France Hambach SARL.

* cited by examiner

PLATE HEAT EXCHANGER WITH SEVERAL MODULES CONNECTED BY SECTIONS

SUMMARY OF THE INVENTION

The invention relates to a plate heater exchanger comprising the following:

- at least two modules, each module having a plurality of stacked passages through which the heat-exchanging media can flow in alternation and which are separated from one another by partitions,
- At least two modules, each module having a plurality of stacked passages through which the heat-exchanging media can flow in alternation and which are separated from one another by partitions,
- The modules being altogether cuboidal and being bordered on the outsides by cover sheets,
- The modules being arranged next to one another such that one rectangular side of one cuboidal module is directly adjacent to a corresponding rectangular side of another cuboidal module,
- The modules having means for supply and discharge of the heat-exchanging media as well as means (headers) for distribution of the heat-exchanging media among the individual passages and for collection of the heat-exchanging media from the individual passages, and
- Whereby at least two modules have at least one common header, The invention further relates to a method for the production of such a plate heater exchanger.

Brazed plate heat exchangers made of aluminum are used in numerous systems at the most varied pressures and temperatures. They are used, for example, in the separation of air, the liquefaction of natural gas, or in plants for producing ethylene.

Such a plate heat exchanger is described in, for example, "The Standards of the Brazed Aluminum Plate-Fin Heat Exchanger Manufacturer's Association," ALPEMA report (2000). A figure taken from this report is shown as FIG. 1 as prior art and is described below.

The plate heat exchanger 1 that is shown in FIG. 1 uses five different process flows A, B, C, D and E for heat exchange. The heat exchanger 1 is block-shaped and is equipped with the various means 6 for supply and discharge of the individual process media. These means 6 are called fittings below and within the scope of this application. The heat exchanger likewise has several means 7 for distributing and collecting the individual process flows A, B, C, D and E, which are called headers below and within the scope of this invention.

The plate heat exchanger 1 essentially comprises a plurality of stacked passages 3 that are separated from one another by partitions 4. The various media flow into the individual passages 3 (see, for example, pages 8-9 of ALPEMA report (2000)). The heat exchange takes place indirectly via thermal contact that is produced by the partitions 4 and by the wavy structures that form the passages 3 (these wavy structures are called heat exchange fins below and within the scope of this application). The individual media A, B, C, D and E are routed into the headers 7 via the fittings 6 and in this way are distributed among the stacked passages 3 that are provided in each case. In the inlet region of the passages, there are so-called distributor fins 2 that provide for a uniform distribution of the medium to the individual passages 3. With regards to these distributor fins 2, see, for example, the ALPEMA report (2000) at pages 9-11. The media thus flow transversely to the wave direction of the heat exchange fins that forms the passages 3. The heat exchange fins are connected to the partitions 4, as a result of which intensive thermal conduction contact is produced. In this way, heat exchange can take place between two different media that flow into adjacent passages 3. Viewed in the direction of flow, on the end of the passage there are similar distributor fins 2 that route the media out of the passages 3 into the headers 7 where they are collected and drained off via the fittings 6. The individual passages 3 are closed to the outside by so-called sidebars 8. The entire heat exchanger block is bordered to the outside by cover sheets 5.

These plate heat exchangers are outstandingly well suited for heat exchange of at least 2 media. As shown in FIG. 1, however, even more than 2 media can also participate in heat exchange by virtue of suitable construction. This allows very effective process management and effective use of heat and cold.

These plate heat exchangers are brazed from, for example, aluminum. The individual passages with the fins, distributor fins, cover sheets and sidebars are stacked on one another, provided with brazing, and brazed in a furnace. Then, headers and fittings are welded onto the resulting block.

Brazing differs from welding in that welding typically requires higher temperatures since in welding the filler material and the metals to be joined are all heated to their melting temperatures. Thus, welding causes the filler material to penetrate into the joining metals, thereby mixing the metals. In brazing, the metals to be joined do not get heated to their melting temperatures. Only the filler material is heated its melting temperature. Thus, in brazing the filler material does not penetrate into the base metals. Brazing is similar to soldering, although brazing uses filler materials having higher melting points than that of typical soldering filler materials. Also, during welding the filler and the joining metals are melted together, making one piece. In brazing the filler is melted into the joint between the joining pieces. During brazing the filler spreads along the joint filling it in. In welding two the filler material melts in place, causing the filler to ripple, and remains in place once it melts, because the filler and the metal join together as one.

The maximum size of such a plate heat exchanger block is also dictated by the just described production method by the size and geometry of the brazing furnace. Often, however, the process requirements necessitate a larger heat exchange surface and thus larger heat exchanger blocks. In these cases, in order to meet these requirements, plate heat exchangers according to the state of the art consist of at least two modules. Within the scope of this application, a module is defined as a heat exchanger block that is produced in a brazing furnace as described initially. Several such modules are connected to one another according to the prior art and are equipped with common headers for distribution and collection of the media that participate in the heat exchange. In this case, the connection between two different modules of a plate heat exchanger takes place according to the prior art by way of sidebars.

The plate heat exchanger that is shown in FIG. 1 according to the prior art consists of one module. In order to produce a plate heat exchanger with several modules, a heat exchanger block, as shown in FIG. 1, i.e., without headers and fittings, is welded onto a second such heat exchanger block. Along the edges of the cover sheet, sidebars are welded on the cover sheet 5. The second module that is to be joined to the first module is arranged such that the two directly adjacent sides of the two modules each have the same shaped cover sheets. The surface that is formed by one cover sheet that is directly adjacent to another module is called the contact surface below. For purposes of connection, the cover sheet is welded to the sidebars on the cover sheet of the directly adjacent module. Therefore, according to the prior art, the sidebars form more or less a frame on the cover sheet. This frame is welded onto the cover sheet of the adjacent module and in this way a connection is produced between two modules. The two connected modules thus form a new heat exchanger block that is larger than the actual geometry of the brazing furnace. In this way, any number of modules can be joined to one another to form a heat exchanger block of any size. Here, two adjacent modules have at least one common header.

Between two modules of such a plate heat exchanger, thus between the cover sheets, a layer of air forms that in this way forms more or less a passage that does not carry pressure, which does not participate in heat exchange, and through which flow has not taken place. Accordingly, the thermal contact between two modules is much worse than the thermal contact within one module. This leads to thermal stresses within plate heat exchangers having at least two modules in various applications.

Thus, one aspect of this invention is to configure a plate heat exchanger having at least two modules, as described above, such that a connection between two directly adjacent least two modules is produced. Forces, for example resulting from thermal stresses between two modules, will be minimized, and the mechanical strength of the entire block that contains at least two modules will be increased.

Upon further study of the specification and appended claims, other aspects and advantages of the invention will become apparent.

These aspects are achieved by a plate heat exchanger comprising of at least two modules, wherein each module has a plurality of stacked passages through which the heat-exchanging media can flow in alternation and which are separated from one another by partitions. The modules are altogether cuboidal and bordered on the outsides by cover sheets. The modules are further arranged next to one another such that one rectangular side of one cuboidal module is directly adjacent to a corresponding rectangular side of another cuboidal module. The modules have means for supply and discharge of the heat-exchanging media, as well as means (headers) for distribution and collection of the heat-exchanging media among the individual passages or from the individual passages. Further, at least two modules have at least one common header. In addition, at least one formed part on each of the two cover sheets that form the respectively directly adjacent sides of two adjacent modules, hereinafter called contact surfaces, and (a) the formed parts are arranged and shaped such that the movement of the modules perpendicular to the contact surface is prevented by the at least one formed part on one contact surface and the at least one formed part on the other contact surface, or (b) the formed parts are arranged and shaped such that the movement of the modules perpendicular to the contact surface is prevented by the at least one formed part on one contact surface, the at least one formed part on the other contact surface, and at least one additional formed part.

According to the invention, at least one formed part is attached on each of the two cover sheets that form the respectively directly adjacent sides of two adjacent modules, these adjacent sides being called contact surfaces. According to one embodiment, the formed parts are arranged and shaped such that the movement of the modules perpendicular to the contact surface is prevented by the at least one formed part on one contact surface and the at least one formed part on the other contact surface. According to a further embodiment, the formed parts are arranged and shaped such that the movement of the modules perpendicular to the contact surface is prevented by the at least one formed part on one contact surface, the at least one formed part on the other contact surface, and at least one additional formed part.

Advantageous further embodiments of the invention are described below and illustrated in the Figures. In accordance with the invention, a formed part is defined as any type of sections, bars, rods, pipes, lengths of pipe, half-shells, balls or the like. In this case, the formed parts can be made of metal (for example, high-grade steel, or copper, or aluminum) or plastic.

In accordance with the invention, the formed parts, in each case at least one formed part per module, are attached on the two modules. In this case, the formed parts are shaped and arranged such that movement perpendicular to the contact surface is prevented. The formed parts therefore prevent the movement of the two modules away from one another. The contact surfaces form 2 planes. According to the arrangement of the modules, these two planes are parallel. The shaping and positioning of the formed parts allow the modules at most one movement in these planes (displacement, rotation). Movement with one movement component that is perpendicular to these two planes is prevented by positioning and shaping of the formed parts. The formed parts are accordingly shaped and positioned such that either one formed part on one contact surface together with one formed part on the other contact surface prevents the movement, or to prevent this movement, an additional third formed part can also be used.

In other words, each contact surface has at least one formed part. One formed part on one contact surface with one formed part of the contact surface of the neighboring module forms one pair of formed parts. Depending on the configuration and positioning of the formed parts, movement perpendicular to the contact surface is prevented already by the pair of formed parts themselves or by the pair of formed parts in conjunction with at least one third formed part.

The connection of the two modules according to the invention via the formed parts yields a much more stable connection than that achieved only via welding on the side edges, as described in the prior art. In this case, the weld connection on the side edges can optionally take place in addition.

The formed parts are preferably fastened on the contact surfaces by brazing, cementing, welding and/or tacking.

According to one configuration of the invention, there is provided, on each contact surface, at least one U-shaped section piece as a formed part wherein at least one side edge of the U-shaped section is fastened on one contact surface. The U-shaped sections are arranged such that one U-shaped section fastened on one contact surface and one U-shaped section fastened on the other contact surface form a pair. The two openings of the U-shaped sections of one pair pointing at one another and, in this way, form a cavity into which another formed part can be inserted.

In this configuration, at least one U-shaped section at a time is fastened on one of the two contact surfaces. One U-shaped section fastened to one contact surface forms a pair with one U-shaped section fastened to the other contact surface. In this case, the U-shaped sections are fastened onto the contact surface via one of the long sides of the U. The short side of the U stands vertically on the contact surface.

The two U-shaped sections of one pair are oriented such that the open sides of the U point at one another. Between the two openings of the U-shaped sections of one pair, a cavity thus forms into which another additional formed part can be inserted. This additional formed part prevents the movement of the contact surfaces in one direction perpendicular to the contact surface, i.e., along one short side of the U. The two U-shaped sections of one pair that are attached to different contact surfaces in each case are prevented by the additional formed part from moving along the short side of the U, as a result of which the movement of the two modules perpendicular to the contact surface is prevented.

In this configuration of the invention, there are advantageously several pairs of U-shaped sections fastened onto the contact surfaces, the pairs preferably being arranged parallel to one another, spaced at regular distances, and distributed over the entire contact surface. The length of the U-shaped sections advantageously corresponds to the length of one side edge of the contact surface.

Especially preferably, the two U-shaped sections of one pair touch one another. Here, touching means that the U-shaped sections within the scope of production tolerances are arranged on the contact surfaces such that at most a small gap forms between opposite long sides of the U of the U-shaped sections of one pair.

According to another configuration of the invention, on each contact surface, at least one hollow section is fastened, the hollow sections being arranged such that at least one hollow section attached to one contact surface forms a pair with one hollow section attached to the other contact surface, the hollow sections each having openings wherein the opening of the hollow sections of one pair are arranged in a straight line such that another formed part can be inserted through the openings and into the two cavities of the hollow sections of one pair.

In this configuration of the invention, hollow sections are arranged as a pair such that the openings of the hollow sections lie in a line. On each contact surface, at least one hollow section is arranged such that it is possible to look through the opening of one hollow section fastened to one contact surface into the opening of the other hollow section fastened to the other contact surface with which the one hollow section fastened to the one contact surface forms a pair. Another formed part is inserted through the openings and into the cavities of the hollow sections of the pair. This another formed part prevents the movement of the two contact surfaces perpendicular to the contact surfaces.

Advantageously, several pairs of hollow sections are arranged in succession in one line (row) parallel to one side edge of the contact surfaces. Preferably, another formed part is fitted into the cavities of several pairs of hollow sections arranged in a line. Especially preferably, a plurality of lines (rows), each line (row) being formed from a plurality of several pairs of hollow sections, are arranged and regularly distributed over the contact surfaces. The cross-sections of the cavities of the hollow sections can in this case have any geometrical shape, especially a rectangle, triangle, polygon, circle or ellipse. Here, the cross-sections can also alternate between hollow sections that are arranged in different lines. The additional formed parts that are fitted into the cavities of the respective pair of hollow sections preferably have a shape that corresponds to the cross-sections of the cavities of the hollow sections.

In one preferred configuration of the invention, the formed parts are formed from pipe lengths. Thus, at least one pipe length is attached on each contact surface, the pipe lengths being arranged such that at least one pipe length attached to one contact surface forms a pair with one pipe length attached to the other contact surface, the openings of the pipe lengths of one pair being arranged in a straight line such that another formed part can be inserted into the two openings of the pipe lengths of one pair.

In this configuration of the invention, pipe lengths are preferably used analogously to the hollow sections of the preceding configuration. Therefore, the description in the preceding paragraphs regarding the formed parts made of hollows sections applies to this configuration wherein the formed parts are made of pipe lengths.

Advantageously, the hollow sections or lengths of pipe of one pair touch on the face side. Here, touching means that the hollow sections or lengths of pipe within the scope of production tolerances are arranged on the contact surfaces such that at most a small gap forms between opposite face sides of the hollow sections or lengths of pipe of one pair.

Advantageously, the other formed part is a rod with a corresponding length and a corresponding cross-section, e.g., rectangular, polygonal, triangular or round cross-section.

In another configuration of the invention, the formed part is a U-shaped section piece. Thus, on each contact surface, at least one U-shaped section piece is fastened by one side edge of the U-shaped section onto the contact surface. The U-shaped sections are arranged such that one U-shaped section, fastened on one contact surface, forms a pair with one U-shaped section fastened on the other contact surface. The two U-shaped sections of one pair are arranged such that the free side edge of one U-shaped section (i.e., the side edge not fastened to a contact surface) is positioned within the opening of the other U-shaped section.

In this configuration of the invention, the movement of the contact surfaces perpendicular to the contact surfaces is prevented by the shape and arrangement of the formed parts themselves. Another formed part is not necessary. The U-shaped sections in this configuration are arranged in pairs such that the long side of the "U" of one U-shaped section that is not attached to the contact surface is located in the opening of the other U-shaped section of the pair, which latter section is fastened on the other contact surface. The U-shaped section fastened on one contact surface forms, so to speak, a guide rail for the long side of the U of one U-shaped section fastened on the other contact surface and vice versa. In other words, the two U-shaped sections of one pair engage one another. In this way, movement along the short side of the U of a U-shaped section, and thus movement perpendicular to the contact surface, is prevented.

Preferably, the two U-shaped sections of one pair touch one another. Touching is defined here as the U-shaped sections being arranged on the contact surfaces within the scope of the production tolerances such that at most a small gap forms between adjacent sides of the U of the U-shaped sections of one pair. Likewise, in this configuration of the invention, several U-shaped sections are also advantageously arranged as pairs on the contact surfaces, the arrangement being preferably parallel and distributed at regular intervals over the entire contact surface. The length of the several U-shaped section pairs (arranged, for example in rows or lines) corresponds advantageously to the length of one side edge of the contact surface.

In another configuration of the invention, on each contact surface, at least one L-shaped section piece is fastened as a formed part with one side edge of the L-shaped section on one contact surface. The L-shaped sections are arranged such that one L-shaped section, which is fastened on one contact surface, forms a pair with one L-shaped section that is fastened on the other contact surface. The two L-shaped sections of one pair are arranged such that the "L" of the L-shaped section is fastened upside-down on the contact surface and the two short sides of the L of the L-shaped section overlap. The L-shaped section fastened on one contact surface forms, so to speak, a guide rail for the short side of the L of one L-shaped section fastened on the other contact surface and vice versa. In this way, movement along the long side of the L of an L-shaped section, and thus movement perpendicular to the contact surface, is prevented.

Preferably, the two L-shaped sections of one pair touch one another. Touching is defined here as the L-shaped sections being arranged within the scope of the production tolerances on the contact surfaces such that at most a small gap forms between adjacent sides of the L of the L-shaped sections of one pair. Likewise, in this configuration of the invention, several L-shaped sections are also advantageously arranged as pairs on the contact surfaces, the arrangement being preferably parallel and distributed at regular intervals over the entire contact surface. The length of the several L-shaped section pairs (arranged, for example in rows or lines) corresponds advantageously to the length of one side edge of the contact surface.

This configuration of the invention is similar to the preceding configuration; here L-shaped sections being used instead of U-shaped sections. The two L-shaped sections of one pair are each fastened on the head on the corresponding contact surface. The long side of the L is thus fastened standing vertically on the contact surface, while the short side of the L is oriented parallel and spaced apart from the contact surface. In each case, the short side of the "L" of the other L-shaped section of the pair is in the cavity that forms in this way. The two L-shaped sections of one pair thus more or less engage one another.

The designation of short and long sides of the L is used here only for the explanation of the orientation of the L-shaped section. The two sides can in fact also be of the same length or with the inverse length ratio.

The aforementioned configurations of the invention can be combined with one another at will. The contact surfaces of two modules of one plate heat exchanger can, for example, have pairs of U-shaped sections, with or without an additional formed part, L-shaped sections, and hollow sections and/or lengths of pipe with an additional formed part.

This invention distinctly improves the connection between two modules of one plate heat exchanger. In particular, in the arrangements of a plurality of pairs of sections over the contact surfaces, an almost flat connection of the two modules is achieved. The described disadvantages of the prior art are avoided.

BRIEF DESCRIPTION OF THE DRAWINGS

Further advantages, features and details of the present invention shall be described in the following with reference to the Figures, wherein:

FIG. 1 was already explained in the introduction of the specification in the assessment of the prior art.

FIG. 2 shows the basic arrangement of two cuboidal modules of a plate heat exchanger as described, here one configuration of a plate heat exchanger 1 according to the invention consisting of two modules 1*a* and 1*b*. The two modules 1*a* and 1*b* are cuboidal and are closed to the outside by cover sheets 5. Both modules 1*a* and 1*b* are arranged such that in each case, cover sheets 9*a* and 9*b* of the same size are directly adjacent. The two cover sheets 9*a* and 9*b* form the contact surfaces between the two modules 1*a* and 1*b* of the plate heat exchanger 1. The formed parts of the configurations of the invention that are explained in more detail in FIGS. 3 to 6 are attached on these contact surfaces 9*a* and 9*b*.

FIG. 3 shows one configuration of the invention in which U-shaped sections 20*a* and 20*b* are attached on the contact surfaces 9*a* and 9*b*. An extract is shown, the cutting plane being perpendicular to the two contact surfaces 9*a*, 9*a*, as shown in FIG. 2.

Figure 1:
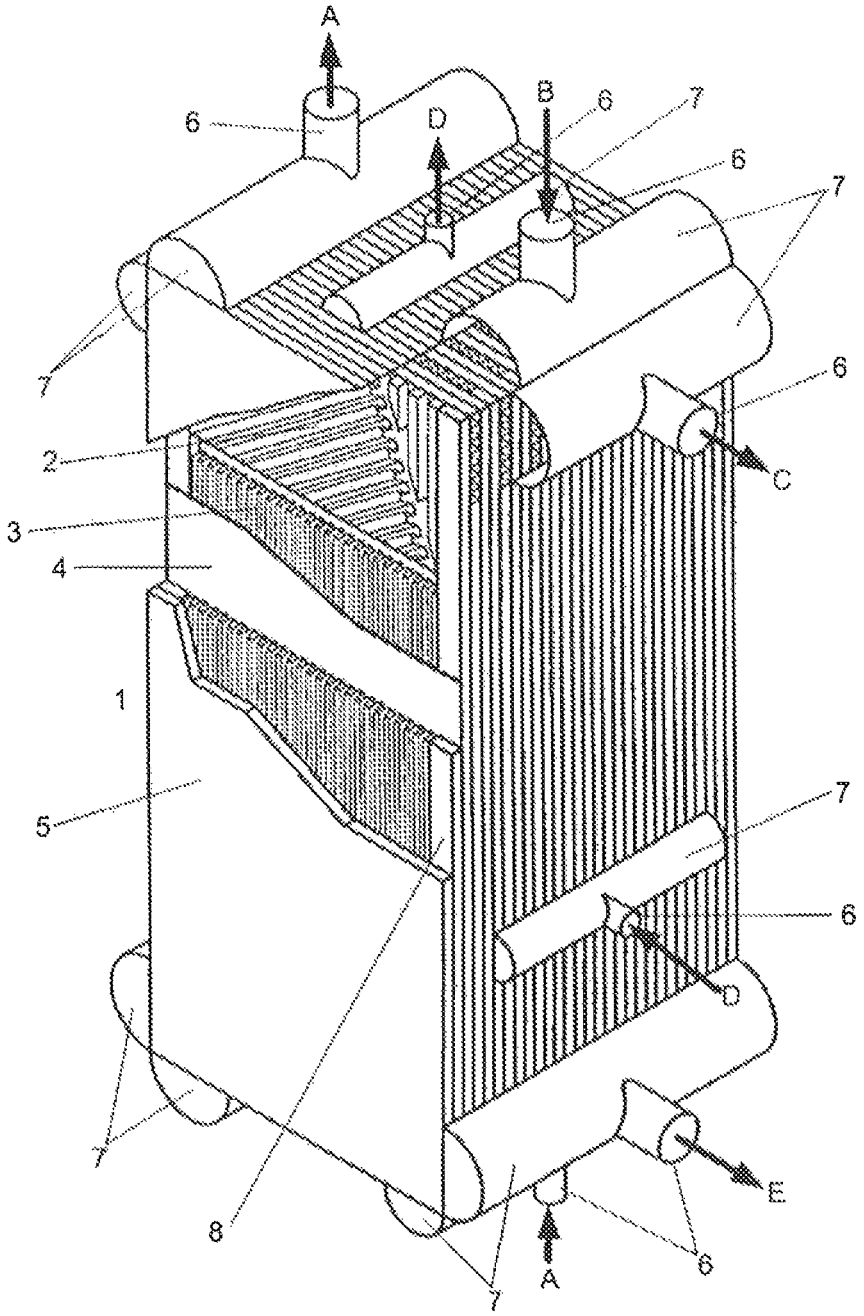
Figure 1 Prior Art
FIG. 1 shows a plate heat exchanger according to the prior art.

The U-shaped sections 20*a* are welded or brazed on one side edge 21*a* of the U-shaped section via a weld joint or a brazed joint 10 to the cover sheet 5 on the contact surface 9*a*. Analogously, the U-shaped sections 20*b* on one side edge 21*b* are attached on the contact surface 9*b* via a weld joint 10. The U-shaped sections are arranged such that their openings 22*a* and 22*b* point at one another and thus form the cavity 23. A rod 50 with a rectangular cross-section that corresponds to the size of the cavity 23 is fitted into this cavity.

The two U-shaped sections 20*a* and 20*b* are arranged on the contact surfaces such that they touch each other. Within the scope of this application, touching means that within the scope of production tolerances of these sections, at most a small gap is formed between the U-shaped sections 20*a* and 20*b*. Likewise, within the scope of production tolerances, the rod 50 is fitted into the cavity 23 that is formed by the two U-shaped sections 20*a* and 20*b* of one pair.

In this configuration of the invention, several U-shaped sections 20*a*, 20*b* are distributed regularly over the two contact surfaces 9*a* and 9*b* so that the intermediate space between the two contact surfaces 9*a* and 9*b* is filled regularly with pairs of sections that are spaced apart from one another. The U-shaped sections 20*a*, 20*b* and the rectangular rods 50 thus have a length that corresponds roughly to the length of one of the side edges of the contact surfaces 9*a*, 9*b*.

The rod 50 that has been inserted between the two U-shaped sections 20*a*, 20*b* of one pair prevents the movement of the modules perpendicular to the contact surfaces. A movement in the plane of the contact surfaces 9*a*, 9*b* is likewise prevented in this configuration of the invention.

In the production of this configuration of a plate heat exchanger according to the invention, first the individual U-shaped sections 20*a* and 20*b* are welded onto the cover sheets 5 of the modules 1*a*, 1*b* that later form the contact surfaces 9*a* and 9*b*. The two modules 1*a*, 1*b* are then joined together on the contact surfaces. In this case, the U-shaped sections 20*a*, 20*b* that are arranged in pairs on the respective contact surfaces form the cavity 23 between the U-shaped sections 20*a*, 20*b* of one pair. The rectangular rods 50 are fitted into these cavities 23 and in this way the two modules 1*a* and 1*b* are connected. In addition, the modules can then be optionally welded via sidebars 8 on the edges, as described in the prior art.

The plurality of the regularly arranged section pairs 20*a*, 20*b* with the corresponding rectangular rods 50, however, in contrast to the prior art, yields a much flatter and thus mechanically more stable connection between the two modules 1*a* and 1*b*.

Figure 2:
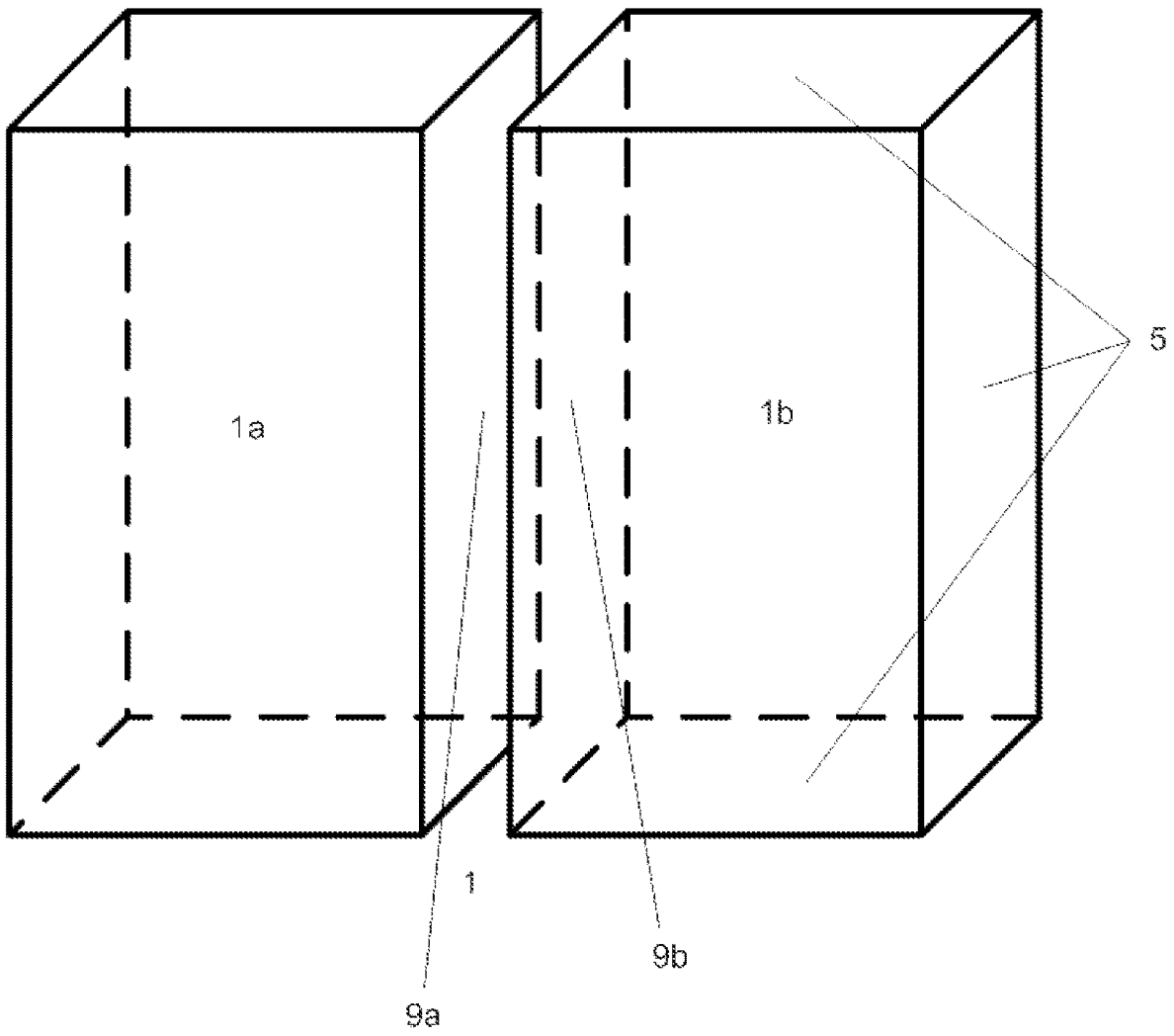
FIG. 2 shows the arrangement of 2 modules in general.
Figure 4:
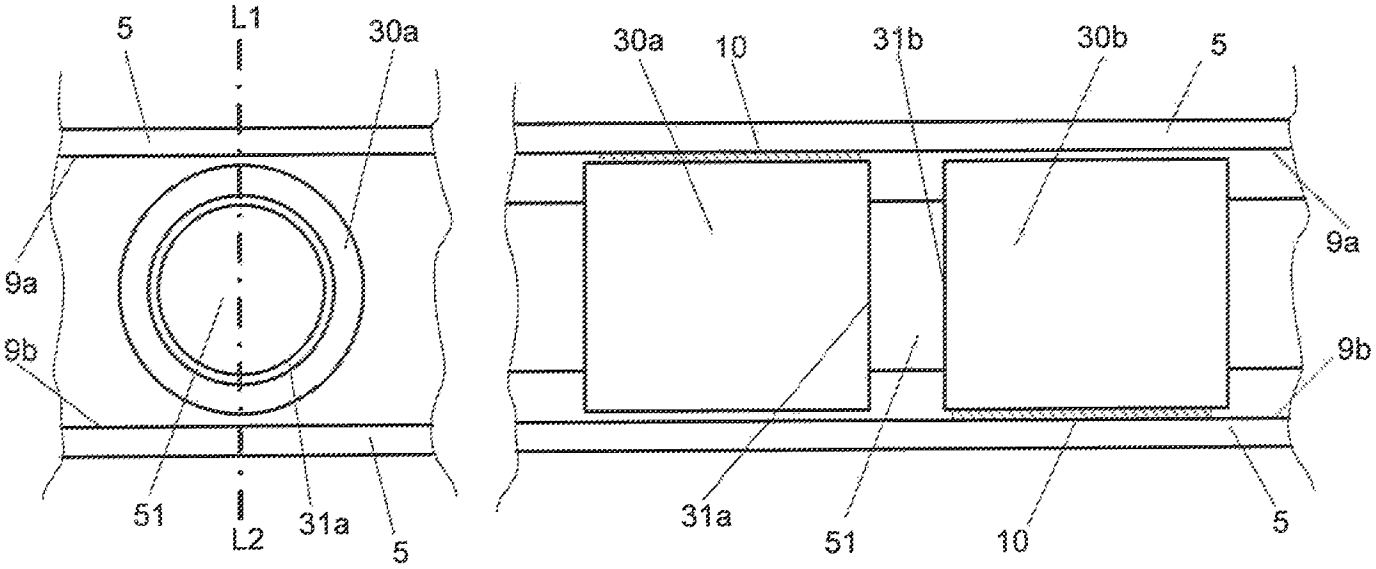
FIG. 4 shows one configuration with lengths of pipe and one rod (additional formed part)

FIG. 4 shows another configuration of the invention in which lengths of pipe 30*a*, 30*b* are fastened on the contact surfaces 9*a*, 9*b*. Here, two extracts are shown, the cutting planes lying perpendicular to the two contact surfaces 9*a*, 9*b*, as shown in FIG. 2. The right-hand representation shows an extract of the cutting plane along L1-L2 of the left-hand representation.

According to the configuration of the invention shown in FIG. 4, lengths of pipe 30*a* and 30*b* are welded 10 onto the contact surfaces 9*a* and 9*b*. In this case, the lengths of pipe 30*a* and 30*b* are arranged in pairs on the contact surfaces 9*a* and 9*b* such that the openings 31*a*, 31*b* of the lengths of pipe 30*a* and 30*b* of one pair lie in a straight line. That is to say, it is thus possible to simultaneously look through the opening 31*a* in the length of pipe 30*a* and through the opening 31*b* in the length of pipe 30*b* of one pair. A round rod 51 is fitted into these two openings 31*a* and 31*b*. The movement of the two modules 1*a* and 1*b* in one direction perpendicular to the contact surfaces 9*a* and 9*b* is prevented by the round rod 51 in the lengths of pipe 30*a* and 30*b* that are fastened on the contact surfaces 9*a* and 9*b* respectively. In addition, at the same time, the relative movement of the modules 1*a*, 1*b* in the contact planes 9*a* and 9*b* is prevented.

Also, in this configuration of the invention, several pairs of pipe lengths 30*a*, 30*b* are arranged in succession in a line so that a line of several pairs 30*a*, 30*b* extends over the entire length of one side length of the contact surfaces 9*a*, 9*b*. Of these lines, several lines are distributed at regular distances over the other side length of the contact surfaces 9*a*, 9*b* so that the contact surfaces are filled with a plurality of regularly arranged pairs of pipe lengths 30*a*, 30*b*. A corresponding round rod 51 is fitted into each line of successively arranged pairs of pipe lengths 30*a*, 30*b* so that the openings 31*a*, 31*b* of the pipe lengths 30*a*, 30*b* are filled by the rod 51. Thus, in this configuration of the invention, the cross-section of the rod 51 is chosen such that at most one gap between the rod 51 and the inner wall of the pipe lengths 30*a*, 30*b* is formed within the scope of the production tolerances.

In this configuration of the invention, the pipe lengths 30*a*, 30*b* of one pair are spaced apart from one another. Alternatively, the pipe lengths 30*a*, 30*b* can be arranged such that the face sides touch each other (not shown).

Figure 3:
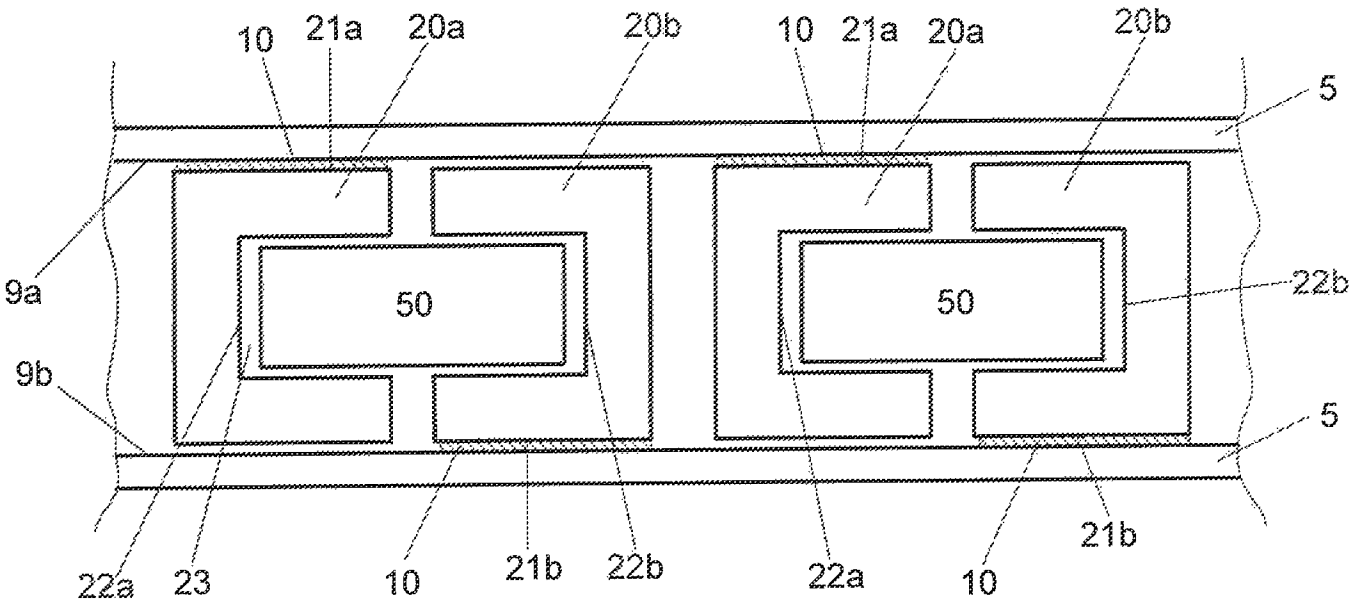
FIG. 3 shows one configuration with U-shaped sections and one rod (additional formed part)

The production of this configuration of a plate heat exchanger 1 takes place similarly to the configuration that is shown in FIG. 3. In the production of such a configuration of a plate heat exchanger 1 according to the invention, first the individual pipe lengths 30*a*, 30*b* are welded onto the cover sheets 5 of the modules 1*a*, 1*b* that later form the contact surfaces 9*a* and 9*b*. The two modules 1*a*, 1*b* are then joined together on the contact surfaces. The pipe lengths 30*a*, 30*b* that are arranged in pairs on the respective contact surfaces in this case form the cavity in the openings 31*a*, 31*b* of the pipe lengths 30*a*, 30*b* of one pair. The round rods 51 are fitted into these cavities and thus the two modules 1*a* and 1*b* are connected. In addition, the modules can then be welded optionally via sidebars 8 on the edges, as in the prior art.

The plurality of regularly arranged pipe lengths 30*a*, 30*b* and the round rods 51 in this configuration of the invention also yield a much flatter and thus mechanically more stable connection between the two modules 1*a* and 1*b* than in the prior art.

One configuration with hollow sections (not shown) is analogous to the configuration with pipe lengths described in FIG. 4.

Figure 5:
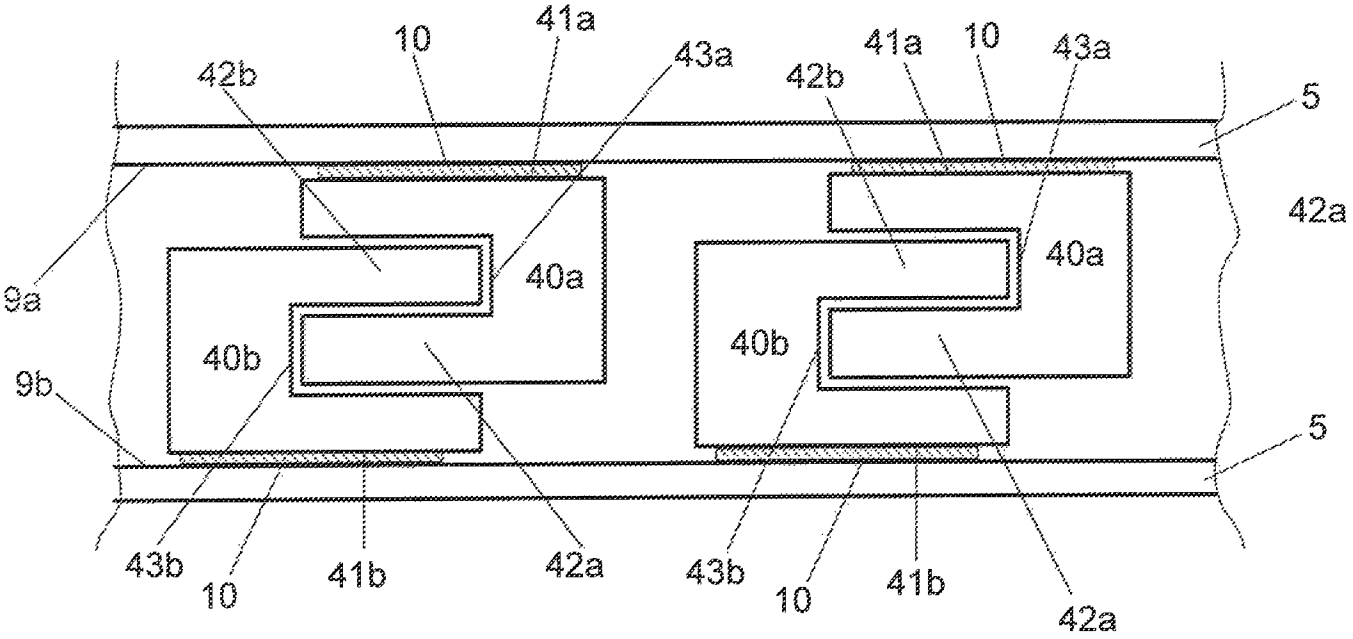
FIG. 5 shows one configuration with U-shaped sections without an additional formed part.

FIG. 5 shows another configuration of the invention in which only U-shaped sections 40*a*, 40*b* prevent the movement of the modules 1*a*, 1*b* perpendicular to the contact surfaces 9*a*, 9*b* without other additional formed parts being used. An extract is analogously shown, the cutting plane being perpendicular to the two contact surfaces 9*a*, 9*b*, as shown in FIG. 2.

In this configuration of the invention, on each contact surface 9*a*, 9*b*, U-shaped sections 40*a*, 40*b* with one side edge 41*a*, 41*b* are attached by means of a weld joint 10. The U-shaped sections 40*a*, 40*b* are arranged such that one U-shaped section 40*a* that is attached to contact surface 9*a* forms a pair with another U-shaped section 40*b* attached to the other contact surface 9*b*. The free side edges 42*a*, 42*b* (the side edges of the U-shaped sections 40*a*, 40*b* that are not welded to the contact surfaces 9*a*, 9*b*) of the U-shaped sections 40*a*, 40*b* are located in the openings 43*b*, 43*a* of the respective other U-shaped section 40*b*, 40*a*.

The U-shaped section 40*a* that is attached on one contact surface 9*a* forms, so to speak, a guide rail for the long side 42*b* of the U of one U-shaped section 40*b* that is fastened on the other contact surface 9*b* and vice versa. In this way, movement along the short side of the U of the U-shaped sections 40*a*, 40*b*, and thus movement perpendicular to the contact surfaces 9*a*, 9*b*, is prevented.

Preferably, the two U-shaped sections 40*a*, 40*b* of one pair touch one another. Touching is defined here as the U-shaped sections 40*a*, 40*b* being arranged within the scope of the production tolerances on the contact surfaces 9*a*, 9*b* such that at most a small gap forms between adjacent sides 42*a*, 42*b*, 43*a*, 43*b* of the U of the U-shaped sections 40*a*, 40*b* of one pair.

In this configuration of the invention, several U-shaped sections 40*a*, 40*b* are also arranged regularly over the two contact surfaces 9*a* and 9*b* so that the intermediate space between the two contact surfaces 9*a* and 9*b* is filled regularly with pairs of sections that are spaced apart from one another. The plurality of U-shaped section pairs 40*a*, 40*b* thus have a length that corresponds roughly to the length of one of the side edges of the contact surfaces 9*a*, 9*b*.

In the production of this configuration of a plate heat exchanger 1 according to the invention, first the individual U-shaped sections 40*a* and 40*b* are welded onto the cover sheets 5 of the modules 1*a*, 1*b* that later form the contact surfaces 9*a* and 9*b*. The two modules 1*a*, 1*b* are then joined together on the contact surfaces, the U-shaped sections 40*a*, 40*b* being inserted into one another, similarly to the joining of two guide rail systems. The joined modules 1*a* and 1*b* are then connected to one another. In addition, the modules can then be welded optionally via sidebars 8 on the edges, as in the prior art.

A much flatter and thus mechanically more stable connection between the two modules 1*a* and 1*b* than in the prior art is also achieved in this configuration of the invention.

Figure 6:
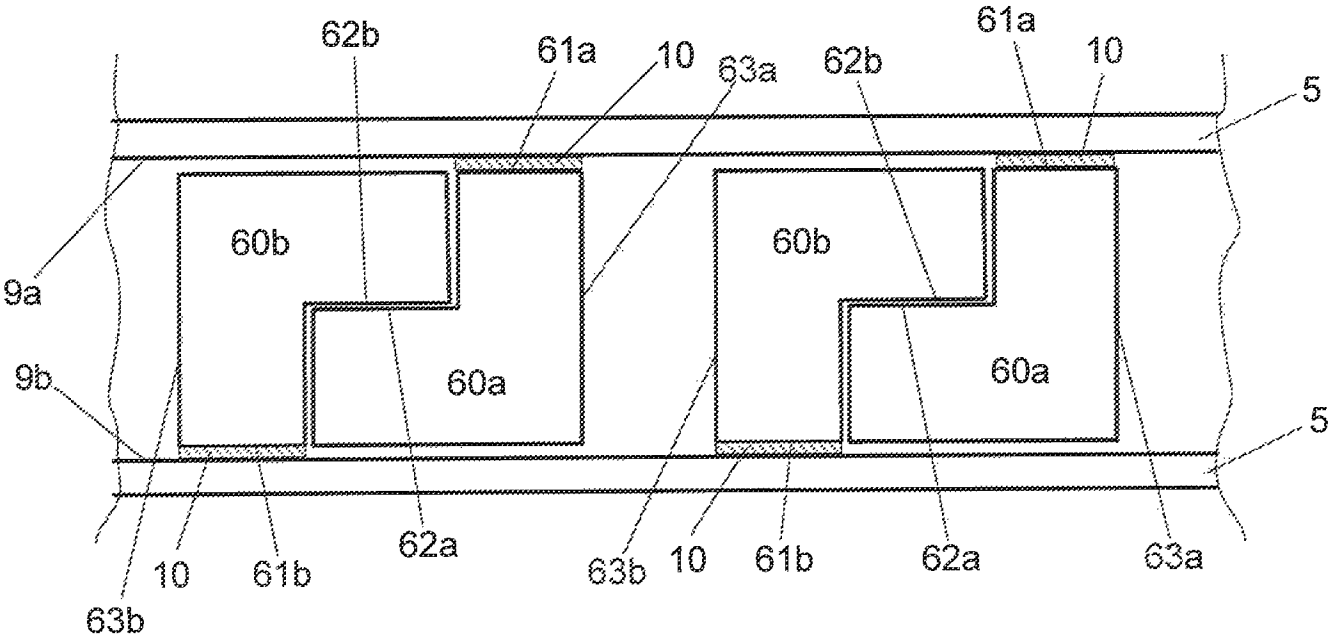
FIG. 6 shows one configuration with L-shaped sections without an additional formed part.
Figure 7:
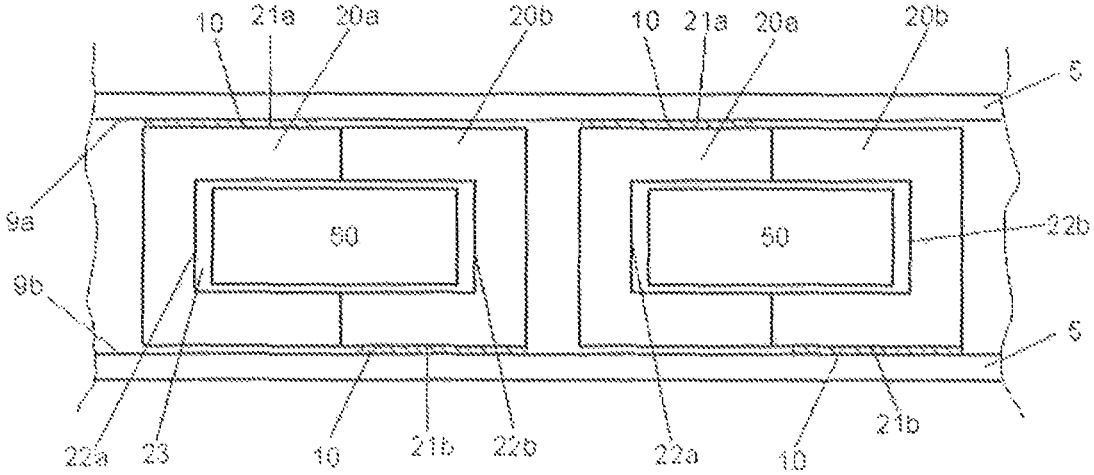
FIG. 7 shows a configuration like FIG. 3 wherein the U-shaped sections are directly touching.

In the additional configuration of the invention shown in FIG. 6, on each contact surface, at least one L-shaped section piece 60*a*, 60*b* as a formed part is fastened on one contact surface 9*a*, 9*b* via a side edge 61*a*, 61*b* of the L-shaped section 60*a*, 60*b*. The L-shaped sections 60*a*, 60*b* are arranged such that one L-shaped section 60*a* that has been fastened on one contact surface 9*a* forms a pair with another L-shaped section 60*b* that has been fastened on the other contact surface 9*b*. The two L-shaped sections 60*a*, 60*b* of one pair are arranged such that the "L" of the L-shaped section 60*a*, 60*b* is attached upside-down on the contact surface 9*a*, 9*b*, and the two short sides 62*a*, 62*b* of the L of the L-shaped section 60*a*, 60*b* overlap. The L-shaped section 60*a* that is attached on one contact surface 9*a* forms, so to speak, a guide rail for the short side 62*b* of the L of one L-shaped section 60*b* that is fastened on the other contact surface 9*b* and vice versa. In this way, movement along the long side 63*a*, 63*b* of the L of one L-shaped section 60*a*, 60*b*, and thus movement perpendicular to the contact surface 9*a*, 9*b*, is prevented.

Preferably, the two L-shaped sections 60*a*, 60*b* of one pair touch one another. Touching is defined here as the L-shaped sections 60*a*, 60*b* being arranged within the scope of the production tolerances on the contact surfaces 9*a*, 9*b* such that at most one small gap forms between adjacent sides 62*a*, 62*b* of the L of the L-shaped sections 60*a*, 60*b* of one pair.

Also, in this configuration of the invention, several L-shaped sections 60*a*, 60*b* are distributed regularly over the contact surfaces 9*a* and 9*b* so that the intermediate space between the two contact surfaces 9*a* and 9*b* is filled regularly with pairs of sections that are spaced apart from one another. The plurality of L-shaped section pairs 60*a*, 60*b* thus have a length that corresponds roughly to the length of one of the side edges of the contact surfaces 9*a*, 9*b*.

A much flatter and thus mechanically more stable connection between the two modules 1*a* and 1*b* than in the prior art is also achieved in this configuration of the invention.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

The entire disclosures of all applications, patents and publications, cited herein and of corresponding German patent application No. 10 2012 006477.2, filed Mar. 29, 2012, are incorporated by reference herein.

The invention claimed is:

1. A plate heat exchanger (1) comprising:

at least two plate heat exchanger modules (1*a*, 1*b*), wherein each module (1*a*, 1*b*) comprises a plurality of stacked passages (3) through which heat-exchanging media can flow in alternation and that are separated from one another by partition plates (4), wherein the passages are closed to the outside by sidebars (8), said modules (1*a*, 1*b*) having an overall cuboidal shape and being bordered on the outsides by cover sheets (5), said modules (1*a*, 1*b*) are arranged next to one another such that one rectangular side (9*a*) of one cuboidal module (1*a*) is directly adjacent to a corresponding rectangular side (9*b*) of another cuboidal module (1*b*), said modules (1*a*, 1*b*) further comprising means (6) for supplying and discharging heat-exchanging media and means (7) for distributing heat-exchanging media among the individual passages (3) and collecting heat-exchanging media from said individual passages (3), and said at least two modules (1*a*, 1*b*) having at least one common header (7), said plate heat exchanger further comprising one or more formed parts (20*a*, 20*b*, 30*a*, 30*b*, 40*a*, 40*b*, 60*a*, 60*b*) at a time is directly attached by brazing, cementing, welding and/or tacking on one of the two cover sheets (5) that form the respectively directly adjacent sides (9*a*, 9*b*) of two adjacent modules (1*a*, 1*b*), and one or more other formed parts (20*a*, 20*b*, 30*a*, 30*b*, 40*a*, 40*b*, 60*a*, 60*b*) at a time is directly attached by brazing, cementing, welding and/or tacking on the other of said two adjacent cover sheets that form the respectively directly adjacent sides (9*a*, 9*b*) of two adjacent modules (1*a*, 1*b*), said directly adjacent sides (9*a*, 9*b*) hereinafter called contact surfaces (9*a*, 9*b*), and either (a) said formed parts (40*a*, 40*b*, 60*a*, 60*b*) being arranged, shaped, and engaged with one another such that the movement of said modules (1*a*, 1*b*) perpendicular to the contact surfaces (9*a*, 9*b*) is prevented by the one or more formed parts (40*a*, 60*a*) on the one contact surface (9*a*) and the one or more other formed parts (40*b*, 60*b*) on the other contact surface (9*b*), or (b) said one or more formed parts and said one or more other formed parts (20*a*, 20*b*, 30*a*, 30*b*) being arranged and shaped such that the movement of the modules (1*a*, 1*b*) perpendicular to the contact surface (9*a*, 9*b*) is prevented by said one or more formed parts (20*a*, 30*a*) on the one contact surface (9*a*), said one or more other formed parts (20*b*, 30*b*) on the other contact surface (9*b*), and one or more additional formed parts (50, 51), wherein each of said additional formed parte engages one of said one or more formed part and one of said one or more other formed part.

2. The plate heat exchanger (1) according to claim 1, wherein on each contact surface (9*a*, 9*b*), said one or more formed parts and said one or more other formed parts are each a U-shaped section piece (20*a*, 20*b*) wherein at least one side edge (21*a*, 21*b*) of each of said U-shaped section piece (20*a*, 20*b*) is fastened on the one contact surface or one the other contact surface (9*a*, 9*b*), each of said U-shaped section piece (20*a*, 20*b*) being arranged such that one of the U-shaped section pieces (20*a*) fastened on the one contact surface (9*a*) forms a pair with another U-shaped section piece (20*b*) fastened on the other contact surface (9*b*), and wherein the two openings (22*a*, 22*b*) of the U-shaped sections pieces (20, 20*b*) that form said pair are pointing at one another to thereby form a cavity (23) into which one of said additional formed parts (50) can be inserted.

3. The plate heat exchanger (1) according to claim 2, wherein the two U-shaped sections (20*a*, 20*b*) of each pair touch each other.

4. The plate heat exchanger (1) according to claim 3, wherein several pairs of said U-shaped sections are fastened onto said contact surfaces, said pairs of said U-shaped sections being arranged parallel to one another, spaced at regular distances, and distributed over the contact surfaces.

5. The plate heat exchanger (1) according to claim 2, wherein said at least one additional formed part is a rod (50, 51) having a length and cross-section corresponding to the length and cross-section of said cavity (23).

6. The plate heat exchanger (1) according to claim 1, wherein each of said one or more formed parts on the one contact surface forms a pair of formed parts with the one of said one or more other formed part on the other contact surface of the adjacent module, wherein the movement perpendicular to the contact surfaces is prevented by said pair of formed parts acting in conjunction with one of said additional formed parts.

7. The plate heat exchanger (1) according to claim 1, wherein each of said one or more formed parts and said one or more other formed parts is a hollow section having a cavity, the hollow sections being arranged such that a hollow section that has been attached on the one contact surface (9*a*) forms a pair with another hollow section that has been attached on the other contact surface (9*b*), the openings of the hollow sections of the pair of hollow sections being arranged in a straight line such that one of said additional formed parts can be inserted into the two cavities of the hollow sections of the pair of hollow sections.

8. The plate heat exchanger (1) according to claim 7, wherein the hollow sections of one pair touch on the face side.

9. The plate heat exchanger (1) according to claim 1, wherein each of said one or more formed parts and said one or more other formed parts is a pipe length (30*a*, 30*b*), the pipe lengths (30*a*, 30*b*) being arranged such that a pipe length (30*a*) that has been attached on the one contact surface (9*a*) forms a pair with a pipe length (30*b*) that has been attached on the other contact surface (9*b*), the openings (31*a*, 31*b*) of the pipe lengths (30*a*, 30*b*) of the pair of pipe length being arranged in a straight line such that said one of said additional formed parts (51) can be inserted into the two openings (31*a*, 31*b*) of the pipe lengths (30*a*, 30*b*) of the pair of pipe lengths.

10. The plate heat exchanger (1) according to claim 9, wherein the lengths of pipe (30*a*, 30*b*) of one pair touch on the face side (31*a*, 31*b*).

11. The plate heat exchanger (1) according to claim 1, wherein said formed parts on each of said contact surfaces form one or more pairs wherein each pair defines a cavity (23) there between, and said one or more additional formed parts are each a rod (50, 51) having a length and cross-section that corresponds to the length and cross-section of said cavity (23).

12. The plate heat exchanger (1) according to claim 1, wherein on each contact surface (9*a*, 9*b*), said one or more formed parts and said one or more other formed parts are each a U-shaped section piece (40*a*, 40*b*) with one side edge (41*a*, 41*b*) of the U-shaped section (40*a*, 40*b*) being fastened on one of the two contact surfaces (9*a*, 9*b*), the U-shaped sections (40*a*, 40*b*) being arranged such that one U-shaped section (40*a*) fastened on the one contact surface (9*a*) forms a pair with another U-shaped section (40*b*) fastened on the other contact surface (9*b*), the two U-shaped sections (40*a*, 40*b*) of the pair being arranged such that the free side edge (42*a*) of one U-shaped section (40*a*) is located in the opening (43*b*) of the other U-shaped section (40*b*).

13. The plate heat exchanger according to claim 1, wherein on each contact surface (9*a*, 9*b*), said one or more formed parts and said one or more other formed parts are each an L-shaped section piece (60*a*, 60*b*) with one side edge (61*a*, 61*b*) of the L-shaped section (60*a*, 60*b*) being fastened on one the two contact surfaces (9*a*, 9*b*), the L-shaped sections (60*a*, 60*b*) being arranged such that one L-shaped section (60*a*) fastened on the one contact surface (9*a*) forms a pair with another L-shaped section (60*b*) fastened on the other contact surface (9*b*), the two L-shaped sections (60*a*, 60*b*) of the pair being arranged such that the L of the L-shaped section (60*a*, 60*b*) is fastened upside-down on the contact surface (9*a*, 9*b*), and the two short sides (62*a*, 62*b*) of the L of the L-shaped section (60*a*, 60*b*) overlap.

14. The plate heat exchanger (1) according to claim 1, wherein said formed parts (40*a*, 40*b*, 60*a*, 60*b*) are arranged and shaped such that the movement of said modules (1*a*, 1*b*) perpendicular to the contact surfaces (9*a*, 9*b*) is prevented by the one or more formed parts (40*a*, 60*a*) on the one contact surface (9*a*) and the one or more other formed part (40*b*, 60*b*) on the other contact surface (9*b*).

15. The plate heat exchanger (1) according to claim 1, wherein said one or more formed parts and said one or more other formed parts (20*a*, 20*b*, 30*a*, 30*b*) are arranged and shaped such that the movement of the modules (1*a*, 1*b*) perpendicular to the contact surface (9*a*, 9*b*) is prevented by said one or more formed parts (20*a*, 30*a*) on the one contact surface (9*a*), said one or more other formed parts (20*b*, 30*b*) on the other contact surface (9*b*), and said one or more additional formed parts (50, 51), wherein each of said additional formed parts engages one of said one or more formed part and one of said one or more other formed part.

16. The plate heat exchanger (1) according to claim 1, wherein said formed parts provide a direct thermal contact between the two modules.

17. The plate heat exchanger (1) according to claim 2, wherein several pairs of said U-shaped sections are fastened onto said contact surfaces, said pairs of said U-shaped sections being arranged parallel to one another, spaced at regular distances, and distributed over the entire contact surfaces.

18. The plate heat exchanger (1) according to claim 1, wherein said partition plates are parallel to said cover sheets.

* * * * *